United States Patent [19]

Wessel

[11] 4,168,704

[45] Sep. 25, 1979

[54] MASSAGE DEVICE

[76] Inventor: Hans Wessel, Wildbergerhutte, Reichshof, Fed. Rep. of Germany

[21] Appl. No.: 826,806

[22] Filed: Aug. 22, 1977

[51] Int. Cl.[2] ..... A61H 7/00

[52] U.S. Cl. ..... 128/63; 15/110; 15/222

[58] Field of Search ..... 128/63, 58, 62; 15/110, 15/222

[56] References Cited

U.S. PATENT DOCUMENTS

| | | | |
|---|---|---|---|
| 1,232,075 | 7/1917 | Oates | 15/222 |
| 1,746,075 | 2/1930 | Edwards | 15/222 |
| 4,023,567 | 5/1977 | Wessel | 128/63 |

FOREIGN PATENT DOCUMENTS

| | | | |
|---|---|---|---|
| 99738 | 6/1923 | Switzerland | 15/110 |
| 428281 | 5/1935 | United Kingdom | 15/110 |

*Primary Examiner*—Lawrence W. Trapp

*Attorney, Agent, or Firm*—Andrus, Sceales, Starke & Sawall

[57] ABSTRACT

A massage belt has pimples on one side and bristles on the other, and is made of soft synthetic plastics material. The bristles are anchored in recesses in bosses directly opposite pimples, and the bristle anchoring means extend through the base of each boss and partially into the associated pimple, thereby being safely embedded.

7 Claims, 3 Drawing Figures

MASSAGE DEVICE

BACKGROUND AND SUMMARY OF THE PRESENT INVENTION

The invention relates to massage devices. It is concerned with a massage belt that provides two sorts of surface, one with bristles and the other with a rough, pimpled texture. An example of such a belt is described in my U.S. Pat. No. 4,023,567.

That belt is made up from a plurality of pieces, but principally it comprises an elongated part studded with pimples and an elongated part equipped with bristles, these parts being arranged back-to-back and connected together, for example by high frequency welding when the parts are of suitable plastics material.

This method of production involves high labour costs, since the belt parts have to be accurately positioned with respect to one another and then connected by high frequency welding. Incorrect adjustment can result in immediate rejection of the article, and failure may also happen after a period of use due to imperfect welds.

It is therefore desirable to provide a massage belt which can be more simply, reliably and economically manufactured, and a one piece construction offers a solution. However, it is also desirable that the belt should be soft and flexible, but this presents problems in anchoring the bristles, particularly with an integral construction. Any anchoring means must be firmly embedded and leave no part exposed.

According to the present invention there is provided a massage device in the form of a belt with integrally moulded pimples on one side and provided with bristles on the other, the bristles being secured in bundles by anchors in respective recessed bosses, each boss being located opposite a pimple, and the respective anchor projecting partially into the associated pimple.

In the preferred form, the recessed bosses are moulded integrally with the belt. 10

For reliable bristle anchoring, the height and base diameters of each pimple should be at least equal respectively to the depth of the recess and the base diameter of the associated boss. Preferably, the bottom of each recess should be flat.

With this construction, plastics material of a Shore hardness of 80 to 90 can be used.

BRIEF DESCRIPTION OF THE DRAWING

For a better understanding of the invention, one embodiment will now be described, by way of example, with reference to the accompanying drawing, in which.

DETAILED DESCRIPTION OF THE PREFERRED EMBODIMENT

Figure 1:
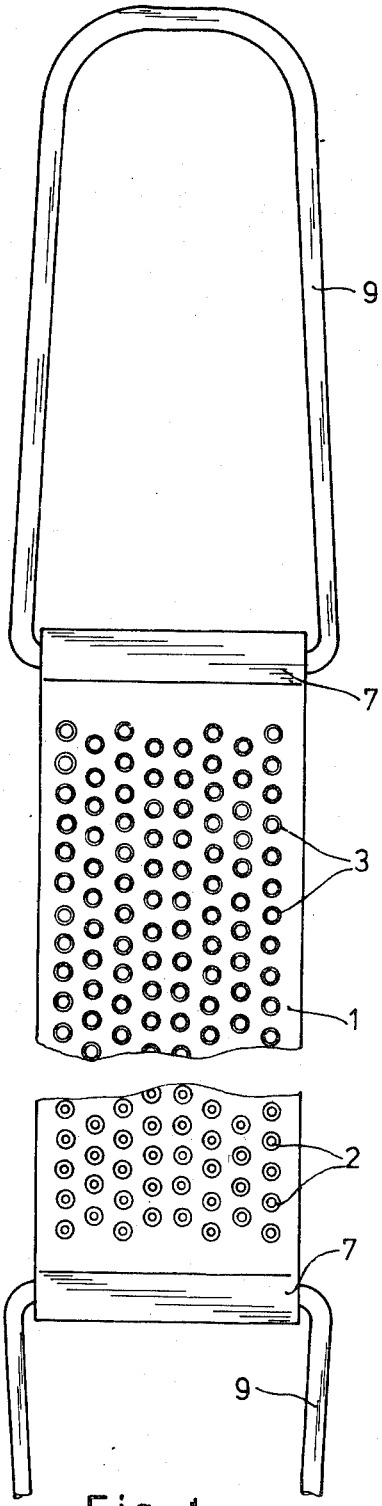
FIG. 1 is a divided partial plan view of a massage belt, one part showing a bristled side and the other part a pimpled side.
Figure 2:
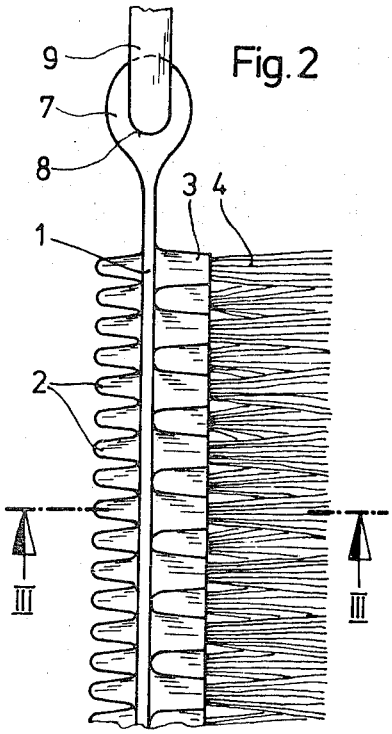
FIG. 2 is a side view of part of the massage belt.
Figure 3:
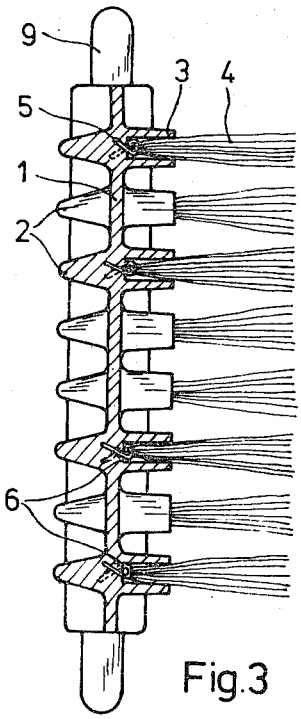
FIG. 3 is a section on the line III—III of FIG. 2.

The massage belt of the drawing includes an elongated strap-like member1 on one side of which pimples 2 and on the other side of which recessed boses 3 are integrally moulded. A bundle 4 of bristles is secured by means of an anchor 5 in each boss 3.

The member 1 is made from an elastic, flexible thermoplastic material, and the bundles 4 of bristles are anchored in the bosses 3 by loop or ring stamping. A synthetic plastics material should be used having a Shore hardness which gives adequate elasticity or flexibility of the belt, but when using such a material the stamping in and anchoring of the bundles of bristles is difficult since each anchor will open out, and possibly pierce the material, only when it strikes a firm resistance. Also, if the synthetic plastics material is too soft, the bundles can easily be pulled out, and if it is too hard the desirable softness and flexibility of the belt will not be provided.

However, with the currently proposed belt construction the material used may be a synthetic plastics material of quite soft consistency, preferably with a Shore hardness of 80 to 90, which has not hitherto been usable.

In this belt each recessed boss 3 is located exactly opposite a pimple 2, and the pimple diameter at its base is at least equal to that of the boss 3. Furthermore, the height of each pimple 2 is at least equal to the depth of the recess 6 in the associated boss 3. This ensures that the anchors are thoroughly embedded and concealed. In order to prevent the anchors 5 being pressed sideways out of the pimples the bottom of each recess 6 is flat.

Although in this preferred example the recessed bosses 3 are integrally moulded on member 1, they could be part of another member, as in Application No. 50314/75.

The member 1 has a thickened portion 7 extending over the whole width at each end. These portions have bores 8 through which endless synthetic plastics cords are threaded to serve as handles 9.

I claim:

1. A massage device in the form of a belt with integrally moulded pimples on one side thereof and provided with bristles on the other side of said belt, said bristles being secured in bundles by anchors in respective recessed bosses, each boss being located on the other side of said belt opposite a pimple, and the respective anchor projecting partially into the associated pimple.

2. A massage device as claimed in claim 1, wherein the height of each pimple is at least equal to the depth of the recess in the associated boss.

3. A massage device as claimed in claim 1, wherein the base diameter of each pimple is at least equal to that of the associated boss.

4. A massage device as claimed in claim 1, wherein the bottom of the recess of each boss is flat.

5. A massage device as claimed in claim 1, wherein the recessed bosses are moulded integrally with the belt.

6. A massage device as claimed in claim 1, wherein the belt is of synthetic plastics material with a Shore hardness of 80 to 90.

7. A massage device comprising a belt of synthetic plastics material with pimples integrally moulded on one side and recessed bosses integrally moulded on the opposite side, each boss being located opposite a pimple, the height of each pimple being at least equal to the depth of the recess in the associated boss, and the base diameter of each pimple being at least equal to that of the associated boss, bundles of bristles entered in the recesses, and anchoring means securing said bundles, each anchoring means projecting partially into the associated pimple.

* * * * *